US011501916B2

(12) United States Patent
Long

(10) Patent No.: US 11,501,916 B2
(45) Date of Patent: Nov. 15, 2022

(54) LAMINATED COIL AND MANUFACTURING METHOD THEREFOR

(71) Applicants: METAFLAT Sci. & Tech. (Shenzhen) Ltd., Guangdong (CN); Haiyang Long, Guangdong (CN); Haifeng Long, Guangdong (CN); Huijun Long, Guangdong (CN)

(72) Inventor: Huijun Long, Guangdong (CN)

(73) Assignees: METAFLAT Sci. & Tech. (Shenzhen) Ltd., Shenzhen (CN); Haiyang Long, Shenzhen (CN); Haifeng Long, Shenzhen (CN); Huijun Long, Shenzhen (CN)

( * ) Notice: Subject to any disclaimer, the term of this patent is extended or adjusted under 35 U.S.C. 154(b) by 120 days.

(21) Appl. No.: 16/969,561

(22) PCT Filed: Mar. 18, 2019

(86) PCT No.: PCT/CN2019/078440
§ 371 (c)(1),
(2) Date: Aug. 13, 2020

(87) PCT Pub. No.: WO2020/001081
PCT Pub. Date: Jan. 2, 2020

(65) Prior Publication Data

US 2021/0012960 A1 Jan. 14, 2021

(30) Foreign Application Priority Data

Jun. 28, 2018 (CN) ..... 201810683709.4

(51) Int. Cl.
*H01F 7/06* (2006.01)
*H01F 41/12* (2006.01)
(Continued)

(52) U.S. Cl.
CPC ..... *H01F 41/127* (2013.01); *H01F 27/2804* (2013.01); *H01F 41/047* (2013.01);
(Continued)

(58) Field of Classification Search
CPC ..... H01F 41/04; H01F 41/047; H01F 41/061; H01F 41/122; H01F 41/127;
(Continued)

(56) References Cited

U.S. PATENT DOCUMENTS 11,211,191 B2 * 12/2021 McChlery ..... H05K 7/20927

FOREIGN PATENT DOCUMENTS

JP 2005130676 A * 5/2005

* cited by examiner

*Primary Examiner* — Paul D Kim

(57) ABSTRACT

A laminated coil and manufacturing method therefor are disclosed. The laminated coil comprises multiple lamination units formed after a base body is folded. The lamination unit comprises an opening, a first common edge, and a second common edge; opening directions of two adjacent lamination units are opposite; the lamination unit is separately jointed with two adjacent lamination units by means of the first common edge and the second common edge, so that the base body in a laminated state forms a spiral power-on path. The base body is sequentially folded to form multiple lamination units, so that the base body in the laminated state forms the spiral power-on path to improve energy efficiency of a rectangular coil. In addition, on the basis of the laminated coil structure, the manufacturing method provided is adopted, and high precision of laminated coil can be highly efficiently manufactured.

16 Claims, 8 Drawing Sheets

(51) Int. Cl.
*H01F 27/28* (2006.01)
*H01F 41/04* (2006.01)
*H01F 27/30* (2006.01)

(52) U.S. Cl.
CPC ..... *H01F 41/122* (2013.01); *H01F 27/30* (2013.01); *H01F 2027/2809* (2013.01)

(58) Field of Classification Search
CPC ..... H01F 27/2804; H01F 27/2847; H01F 2027/2809; H01F 2027/2861; H01F 6/06
See application file for complete search history.

12
111
11
111
11
111
12
1
111
11
111
11
111
11

LAMINATED COIL AND MANUFACTURING METHOD THEREFOR

TECHNICAL FIELD

The present disclosure relates generally to a coil technical field, and more particularly relates to a laminated coil and manufacturing method therefor.

BACKGROUND

The electromagnetic induction devices, such as the electric motor, electric generator, transformer and inductor, all need to use the electromagnetic coil. The traditional electromagnetic coil adopts the circular wire winding technology. The air gap between the circular wires increases the thermal resistance of heat dissipation to the outside from the inside of the coil. These two factors seriously restrict the efficiency of the electromagnetic equipment.

With the increasing requirements for energy conservation and environmental protection, the technology of using a square or flat wire emerges as the times require. The direct replacement of the traditional circular wire by the square wire can receive a very considerable benefit improvement. The energy efficiency of the electromagnetic equipment using the rectangular coil is significantly higher than that of the electromagnetic equipment using the traditional circular coil with the same power. In additional, the energy efficiency of the electromagnetic equipment using the laminated coil with the wire having the rectangular cross-section can be further improved on the basis of the square coil.

However, at present, it is still the technical threshold of the present industry to wind the laminated coil with the rectangular wire. The research focuses on how to design the structure of the laminated coil and how to make the laminated coil efficiently.

The technical problem to be solved by the present application is how to improve the manufacturing efficiency of the laminated coils by designing the structure of the laminated coil.

SUMMARY

The objective of the present disclosure is to provide a laminated coil and manufacturing method therefor, aiming at the above problems of the prior art.

According to an aspect, the present disclosure has provided a laminated coil comprising a plurality of laminated units formed by folding a base body, wherein the laminated unit comprises an opening, a first common edge and a second common edge, wherein opening directions of two adjacent laminated units are opposite, and the laminated unit is separately jointed with two adjacent laminated units by means of the first common edge and the second common edge, so that the base body in a laminated state forms a spiral power-on path.

Advantageously, the laminated unit comprises a U-shaped unit comprising a first arc edge, a second arc edge, a third arc edge, a fourth arc edge, a first connection edge, a second connection edge, a third connection edge and a fourth connection edge; wherein the first common edge, the first arc edge, the first connection edge, the second arc edge, the second common edge, the third arc edge, the second connection edge, the third connection edge, the fourth connection edge and the fourth arc edge are successively jointed end to end to form the U-shaped unit.

Advantageously, the first arc edge of one U-shaped unit is combined with the fourth arc edge of an adjacent U-shaped unit to form an arc with a center angle of 90°, the second arc edge of the U-shaped unit is combined with the third arc edge of the other adjacent U-shaped unit to form an arc with a center angle of 90°; wherein intervals between the first common edge and the fourth connection edge, between the second common edge and the second connection edge are both equal to a half radius of the arc, an interval between the first connection edge and the third connection edge equal to a radius of the arc.

Advantageously, the U-shaped unit further comprises a fifth arc edge jointed the second connection edge and the third connection edge, and a sixth arc edge jointed the third connection edge and the fourth connection edge.

Advantageously, the base body is attached with a conductive layer on its surface, and an insulation layer is wrapped on the conductive layer.

According to a second aspect, the present disclosure has provided a manufacturing method of a laminated coil comprising following steps:

S1. laminated unit procedure, which comprising processing on a base plate to form a base body including a plurality of laminated units, and reserving a connection unit at both ends of the base body; wherein the laminated unit comprises an opening, a first common edge and a second common edge, wherein opening directions of two adjacent laminated units are opposite, and the laminated unit is separately jointed with two adjacent laminated units by means of the first common edge and the second common edge;

S2. folding and lamination procedure, which comprising folding the base body along the first common edge and the second common edge of the laminated unit to form a middleware with laminated units laminated successively;

S3. molding procedure, which comprising molding the middleware according to a preset structure, and reserving an insulation layer interval in the middleware;

S4. insulation procedure, which comprising adding an insulation layer into the insulation layer interval in the middleware, and wrapping the insulation layer on the base body.

According to a third aspect, the present disclosure has further provided a manufacturing method of a laminated coil comprising following steps:

S1. folding procedure, which comprising folding a base plate and reserving a connection unit at both ends of the base body to form a laminated base body;

S2. laminated unit procedure, which comprising processing on the laminated base body to form a laminated unit having an opening and a hollowed-out middle body, wherein opening directions of two adjacent laminated units are opposite, and the laminated unit is separately jointed with two adjacent laminated units by means of the first common edge and the second common edge to form a middleware with laminated units laminated successively; and then reserving an insulation layer interval in the middleware;

S3. molding procedure, which comprising molding the middleware according to a preset structure, and reserving an insulation layer interval in the middleware;

S4. insulation procedure, which comprising adding an insulation layer into the insulation layer interval in the middleware, and wrapping the insulation layer on the base body.

Advantageously, the laminated unit comprises a U-shaped unit comprising a first arc edge, a second arc edge, a third arc edge, a fourth arc edge, a first connection edge, a second connection edge, a third connection edge and a fourth connection edge; wherein the first common edge, the first arc edge, the first connection edge, the second arc edge, the second common edge, the third arc edge, the second connection edge, the third connection edge, the fourth connection edge and the fourth arc edge are successively jointed end to end to form the U-shaped unit.

Advantageously, the first arc edge of one U-shaped unit is combined with the fourth arc edge of an adjacent U-shaped unit to form an arc with a center angle of 90°, the second arc edge of the U-shaped unit is combined with the third arc edge of the other adjacent U-shaped unit to form an arc with a center angle of 90°; wherein intervals between the first common edge and the fourth connection edge, between the second common edge and the second connection edge are both equal to a half radius of the arc, an interval between the first connection edge and the third connection edge equal to a radius of the arc.

Advantageously, the base body is attached with a conductive layer on its surface, and an insulation layer is wrapped on the conductive layer.

In the laminated coil and the manufacturing method of the laminated coil according to the present application, the base body is sequentially folded to form multiple laminated units, so that the base body in the laminated state forms the spiral power-on path. Based on the laminated coil structure, by using the manufacturing method of the present application, the laminated coil with the rectangular cross-section or rectangular cross-sections can be manufactured with high precision and efficiency. The coil can be processed to have an expected shape for improving the efficiency of the rectangular coil. In addition, the folding process of the present application can significantly reduce the stress generated during the coil manufacture, thus avoiding the crack caused by the tensile and compression stress during the coil manufacture and improving the effectiveness and reliability of the laminated coil. At the same time, with the base body of the present application as the carrier, the superconducting material is attached to the folded and molded base body, the ultra-thin laminated coil can be made, which expanding the application scope of the laminated coil without limiting the material of the base body. The laminated coil and the manufacturing method of the laminated coil according to the present application can effectively improve the manufacture accuracy and efficiency of the laminated coil, and the related products have a wide range of application fields and are of great significance in practical application and economic benefits.

DETAILED DESCRIPTION OF THE PREFERRED EMBODIMENT

To make the object, the technical solution, and the advantage of the present application more clearly, the present application is further described in detail below with reference to the accompanying embodiments. It should be understood that the specific embodiments described herein are only used to explain the present application rather than used to define the present application.

The embodiment 1 has provided a rectangular laminated coil with unequal coil cross-sections, which is described as follows.

Figure 1:
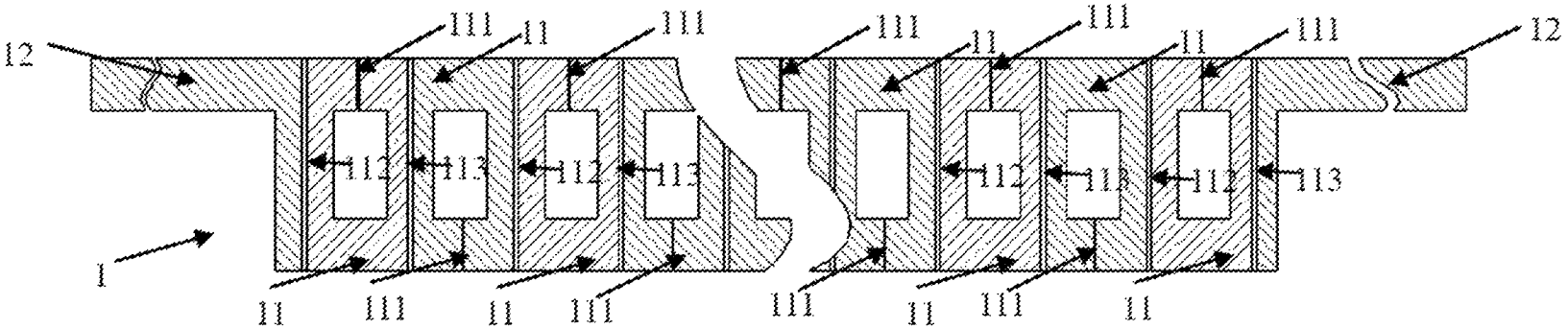
FIG. 1 is a plane diagram showing the expansion of the laminated coil according embodiment 1 of the present application.

As shown in FIG. 1, it is a plane diagram showing the expansion of the laminated coil according embodiment 1 of the present application. The laminated coil comprises a plurality of repetitive laminated units 11 formed by folding a base body 1. The laminated unit 11 has a rectangular ring shape with a width of L, which means the width of the coil is L. The laminated unit comprises an opening 111, a first common edge 112 and a second common edge 113. The opening directions of two adjacent laminated units 11 are opposite, and the laminated unit 11 is separately jointed with two adjacent laminated units by means of the first common edge 112 and the second common edge 113. Two connection units 12 are respectively connected at both ends of the base body.

Figure 2:
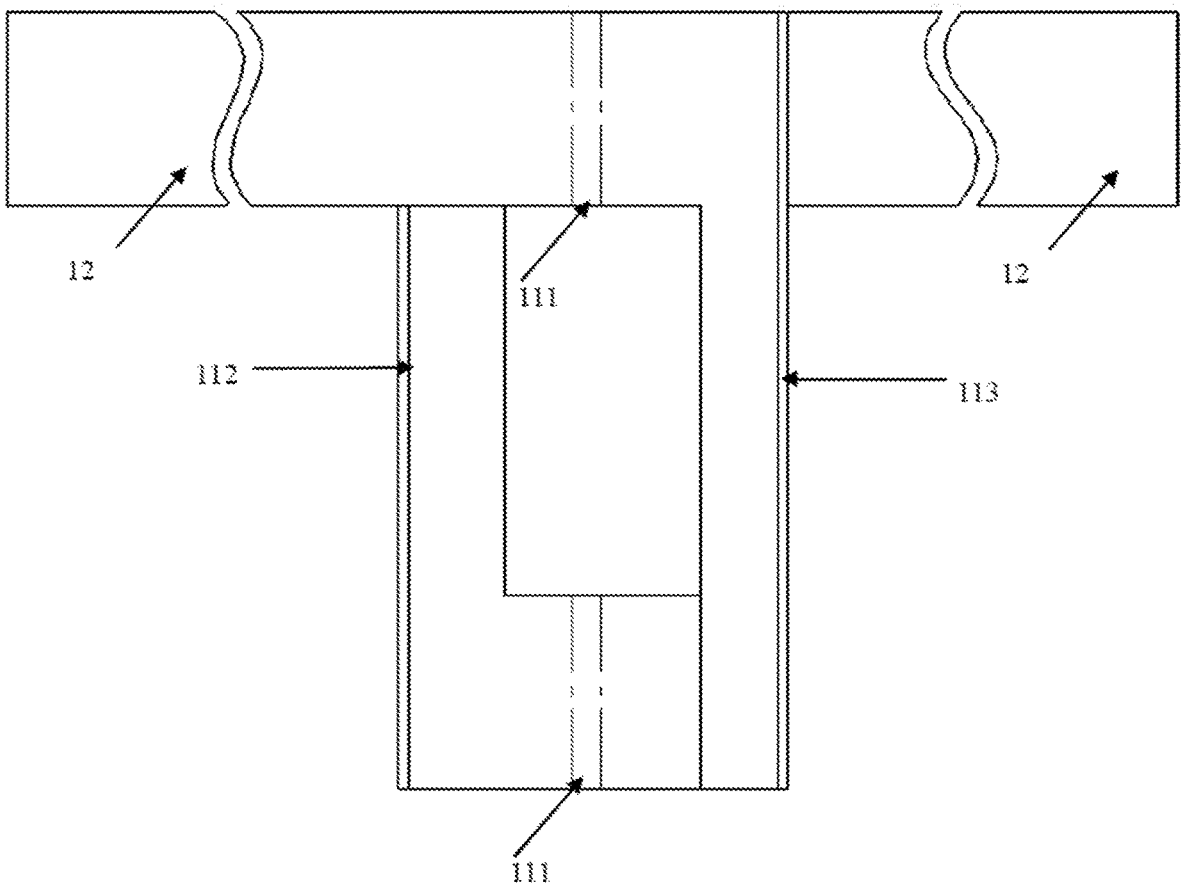
FIG. 2 is a plane diagram showing the folding of the laminated coil according embodiment 1 of the present application.

As shown in FIG. 2, it is a plane diagram showing the folding of the laminated coil according embodiment 1 of the present application. The side lengths of the inner rectangle are a1 and b1 respectively, while the side lengths of the outer rectangle are a2 and b2 respectively.

Among them, the side lengths of the first common edge 112 and the second common edge 113 are a2, while the width c1 of the opening 111 is not larger than the side length b2 of the outer rectangle. The shortest distance from the first common edge 112 to the edge of the inner rectangle is a half of the coil width L.

Figure 3:
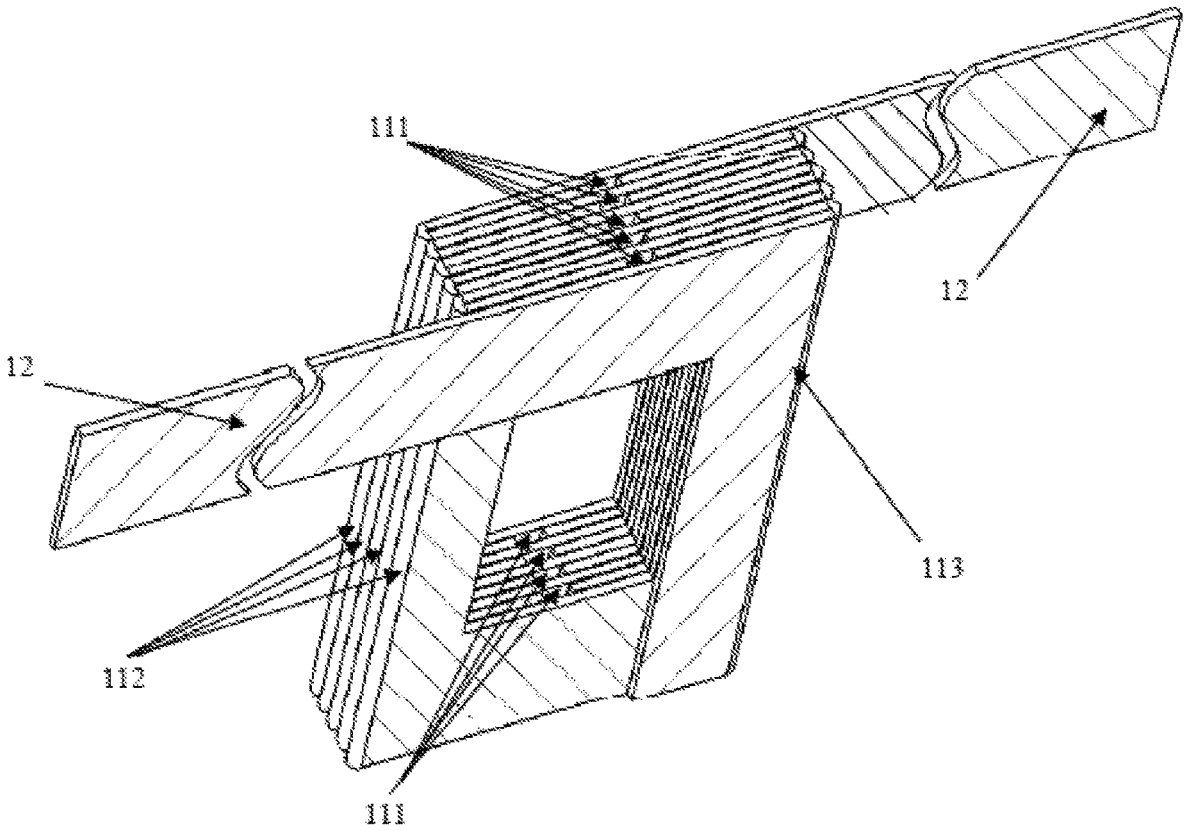
FIG. 3 is a three-dimensional diagram showing the laminated state of the laminated coil according embodiment 1 of the present application.

Furthermore, the base body 1 is folded along the first common edge 112 and the second common edge 113 of the laminated unit 11 to enable the rectangular annular laminated unit with the opening 111 to be laminated successively along the lamination direction. During the process that the laminated unit is laminated successively along the lamination direction, the laminated coil as shown in FIG. 3 is formed. In example 1, the laminated coil does not need complex processes such as welding, bonding or soldering, or adding other connection mechanisms. Through repeatedly folding a piece of base plate and connecting two adjacent laminated units by the folding edges, the laminated coil with rectangular cross-section can be obtained.

Figure 4:
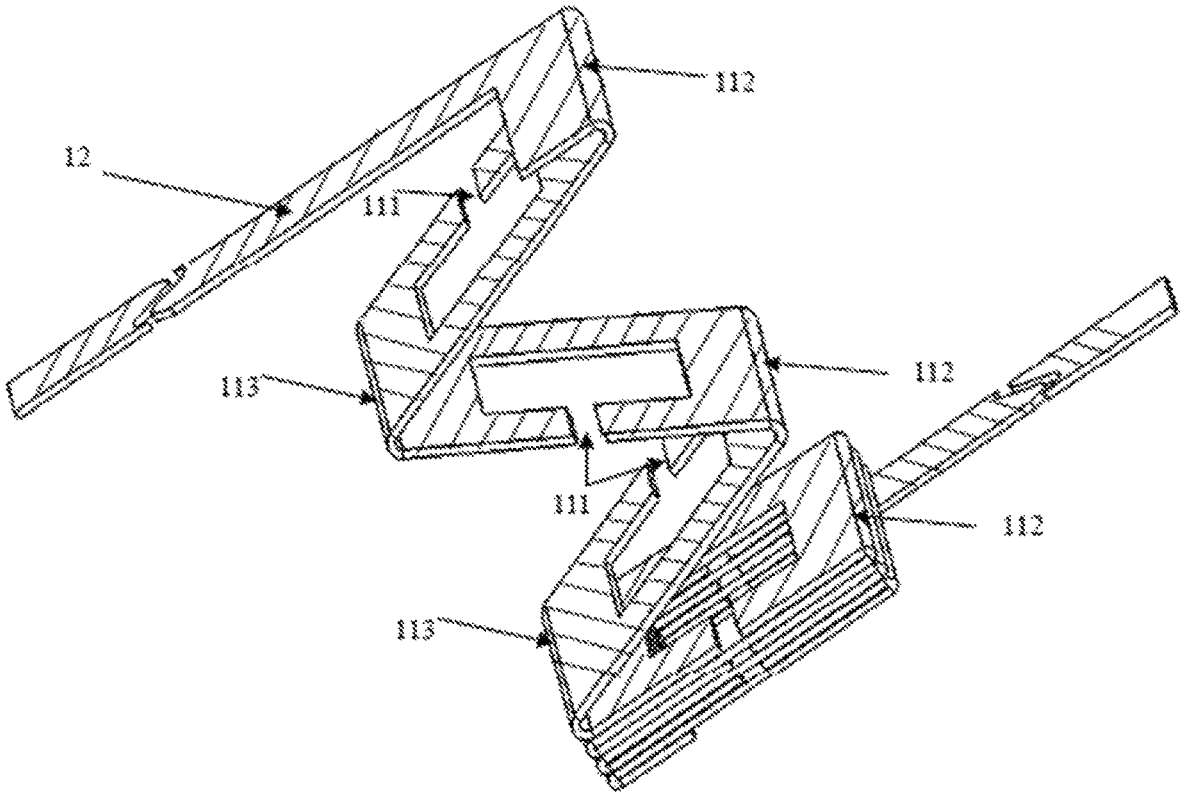
FIG. 4 is a three-dimensional diagram showing the expansion of the laminated coil according embodiment 1 of the present application.

Furthermore, the insulation procedure is implemented after the folding of the laminated unit along the lamination direction and the molding of the obtained laminated unit, such that the base body in the laminated state forms the spiral power-on path and the laminated coil of the final state as shown in FIG. 4 is obtained. The coil with the rectangular cross-section in the embodiment 1 can be applied in the low-frequency current scene. In addition, the superconducting material is attached to the folded and molded base body and then the insulation procedure is implemented on the conductive layer. The base body can be either conductive or non-conductive. The material of the base body is unlimited, and the thickness of the coil can be infinitely small. The ultra-thin laminated coil can be made to expand the application range of the laminated coil.

The embodiment 2 has provided a rectangular laminated coil with an equal coil cross-section, which is described as follows.

Figure 5:
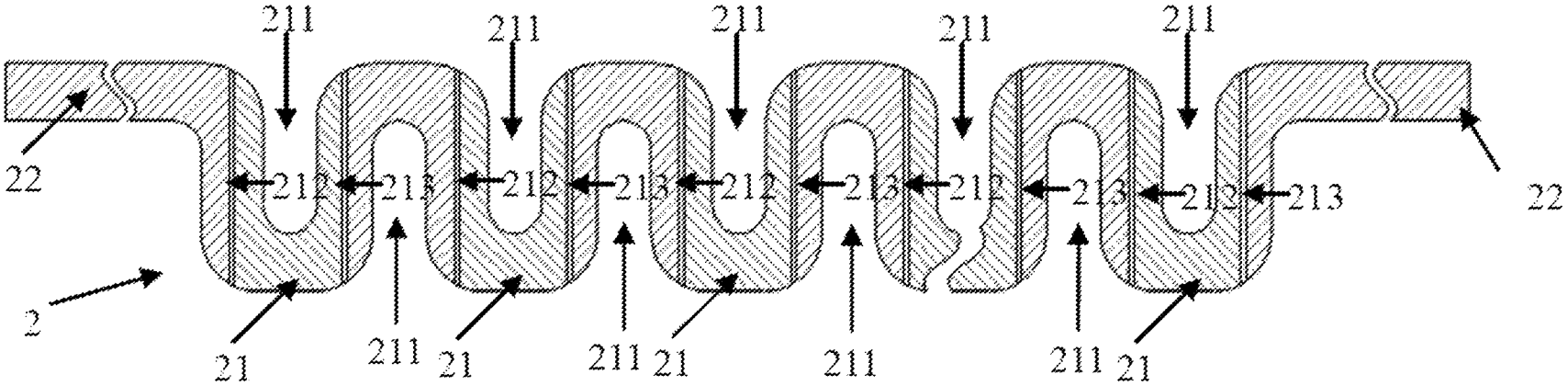
FIG. 5 is a plane diagram showing the expansion of the laminated coil according embodiment 2 of the present application.

As shown in FIG. 5, it is a plane diagram showing the expansion of the laminated coil according embodiment 2 of the present application. The laminated coil comprises a plurality of repetitive laminated units 21 formed by folding a base body 2 and connection unit 12 connected at both ends of the base body. The laminated unit 21 comprises an opening 211, a first common edge 212 and a second common edge 213. The laminated unit 21 is a U-shaped unit having a U-shaped ring structure.

Figure 6:
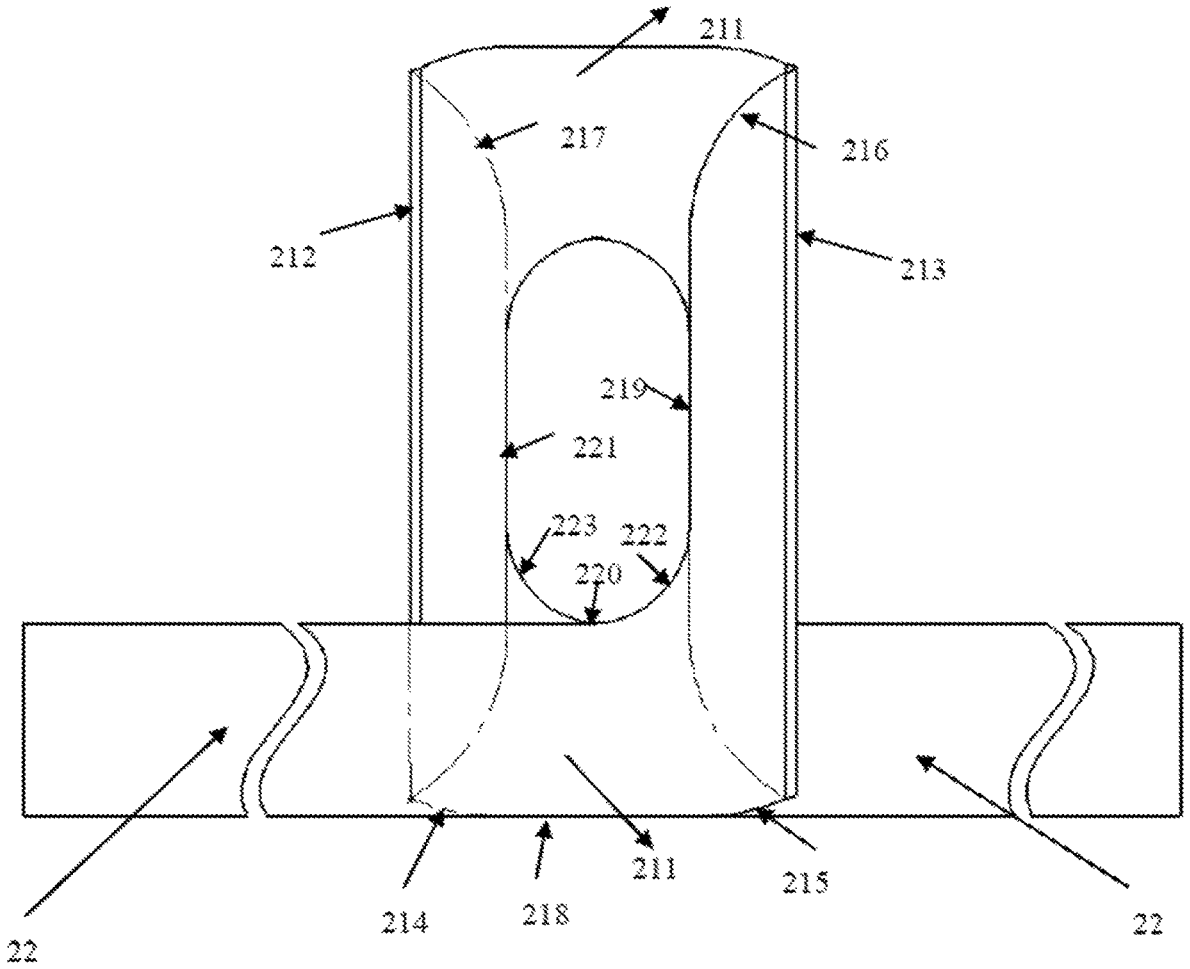
FIG. 6 is a plane diagram showing the folding of the laminated coil according embodiment 2 of the present application.

As shown in FIG. 6, it is a plane diagram showing the folding of the laminated coil. The U-shaped unit further comprises a first arc edge 214, a second arc edge 215, a third arc edge 216, a fourth arc edge 217, a first connection edge 218, a second connection edge 219, a third connection edge 220 and a fourth connection edge 221. The first common edge 212, the first arc edge 214, the first connection edge 218, the second arc edge 215, the second common edge 213, the third arc edge 216, the second connection edge 219, the third connection edge 220, the fourth connection edge 221 and the fourth arc edge 217 are successively jointed end to end to form the U-shaped unit.

Furthermore, the first arc edge 214 of the U-shaped unit is combined with the fourth arc edge 217 of an adjacent U-shaped unit to form an arc with a center angle of 90°, the second arc edge 215 of the U-shaped unit is combined with the third arc edge 216 of the other adjacent U-shaped unit to form an arc with a center angle of 90°. The intervals between the first common edge 212 and the fourth connection edge 221, between the second common edge 213 and the second connection edge 219 are both equal to a half radius of the arc. The interval between the first connection edge 218 and the third connection edge 220 equal to a radius of the arc.

It should be noted that, during the manufacturing process of the laminated coil, the U-shaped unit further comprises a fifth arc edge 222 jointed the second connection edge 219 and the third connection edge 220, and a sixth arc edge 223 jointed the third connection edge 220 and the fourth connection edge 221. The fifth arc edge 222 and the sixth arc edge 223 form a chamfering whose existence conforms to the realization of coil forming in the base body cutting and other processes.

Figure 7:
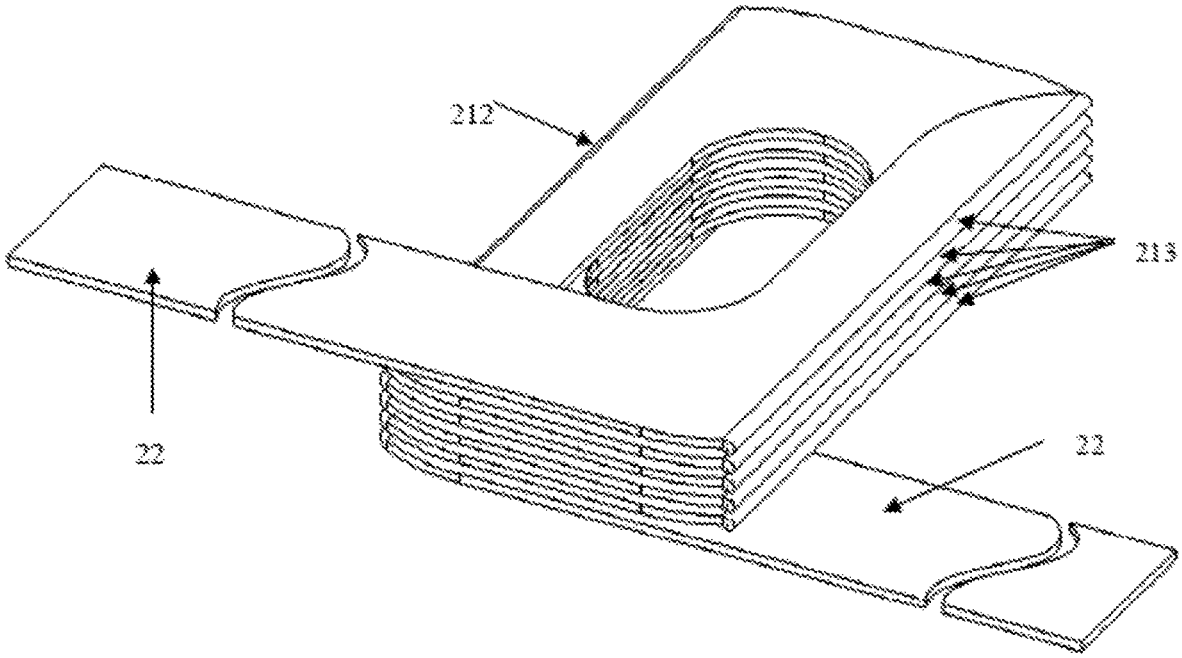
FIG. 7 is a three-dimensional diagram showing the laminated state of the laminated coil according embodiment 2 of the present application.

In additional, the base body 2 is folded along the first common edge and the second common edge to enable the U-shaped unit to be laminated successively along the lamination direction. During the folding process, the laminated state as shown in FIG. 7 is formed. In example 2, the laminated coil does not need complex processes such as welding, bonding or soldering, or adding other connection mechanisms. Through repeatedly folding a piece of base plate and connecting two adjacent laminated units by the folding edges, the laminated coil with equivalent rectangular cross-section can be obtained.

Figure 8:
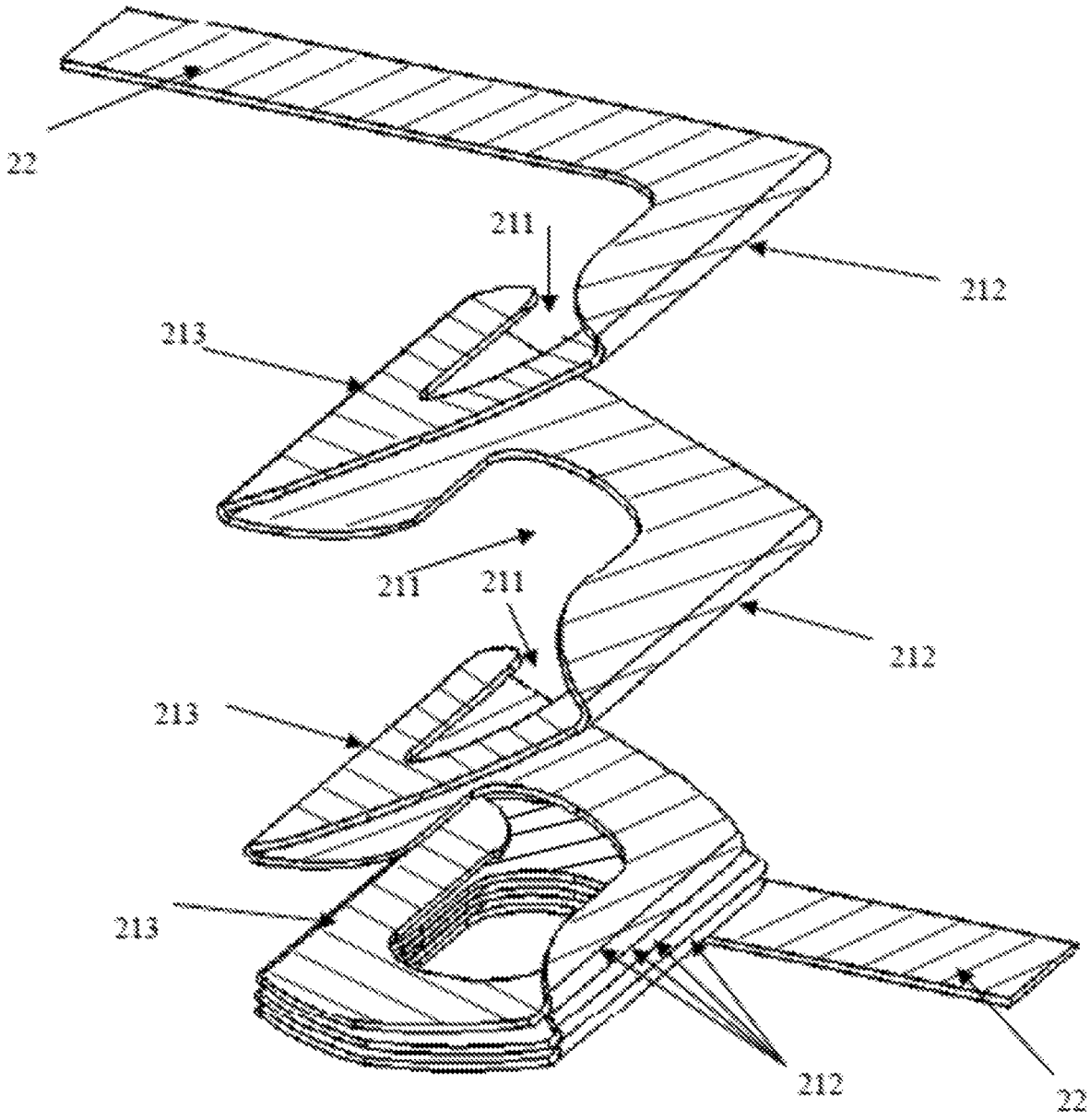
FIG. 8 is a three-dimensional diagram showing the expansion of the laminated coil according embodiment 2 of the present application.

Furthermore, the insulation procedure is implemented after the folding of the laminated unit along the lamination direction and the molding of the obtained laminated unit, such that the base body in the laminated state forms the spiral power-on path and the laminated coil as shown in FIG. 8 is obtained. In addition, the superconducting material is attached to the folded and molded base body and then the insulation procedure is implemented on the conductive layer. The base body can be either conductive or non-conductive. The material of the base body is unlimited, and the thickness of the coil can be infinitely small. The ultra-thin laminated coil can be made to expand the application range of the laminated coil. The laminated coil with equivalent rectangular cross-section in example 2 can be applied to the current scene in the high frequency area to improve the energy efficiency, reduce the heat generation and effectively improve the power density.

Embodiment 3 has further provided a manufacturing method of a laminated coil comprising following steps.

Step S1 refers to the laminated unit procedure, in which the base plate is processed to form a base body including a plurality of laminated units. The connection unit is reserved at both ends of the base body. The laminated unit comprises the opening, the first common edge and the second common edge. The opening directions of two adjacent laminated units are opposite, and the laminated unit is separately jointed with two adjacent laminated units by means of the first common edge and the second common edge. That is, as shown in FIG. 1 and FIG. 5, the base plate is processed to obtain the base body with laminated units.

Step S2 refers to the folding and lamination procedure, in which the base body is folded along the first common edge and the second common edge of the laminated unit to form the middleware with laminated units laminated successively.

Step S3 refers to the molding procedure, in which the middleware is molded according to a preset structure, and the insulation layer interval is reserved in the middleware. In the molding process, the base body in the laminated state can be molded according to the application scenario and specific situation of the laminated coil, and the insulating layer interval should be reserved during the molding process.

Step S4 refers to the insulation procedure, in which the insulation layer is wrapped on the base body after the insulation layer is added into the insulation layer interval in the middleware. In the insulation procedure, the insulation material can be added into the insulation layer interval through spraying, dipping and other processes to form the insulation layer with a certain thickness.

The manufacturing method of a laminated coil in embodiment 3 can improve the manufacturing efficiency of the laminated coils and reduce the stress effect on the coil molding by manufacturing the base body with laminated units firstly and then implementing the folding, lamination and other processes.

Embodiment 4 has further provided a further manufacturing method of a laminated coil comprising following steps.

Step S1 refers to the folding procedure, in which the base plate is folded and the connection unit is reserved at both ends of the base body to form the first middleware in the laminated state. That is, the base plate is folded along the lamination direction and no interval is left between the laminations after being pressed, such that the first middleware in the laminated state is formed.

Step S2 refers to the laminated unit procedure, in which the first middleware in the laminated state is processed to form a base body with a plurality of laminated units having an opening and a hollowed-out middle body, wherein opening directions of two adjacent laminated units are opposite, and the laminated unit is separately jointed with two adjacent laminated units by means of the first common edge and the second common edge to form the second middleware with laminated units laminated successively. In additional, the insulation layer interval is reserved in the second middleware. Preferably, during the laminated unit procedure, the first middleware is perforated so that each lamination layer forms a hollow ring. Then the first middleware in its expanded state is cut off at one end of the adjacent two layers to form the base body with a plurality of hollow laminated units having opposite opening directions. Finally, the laminated unit is separately jointed with two adjacent laminated units by means of the first common edge and the second common edge to form the second middleware with laminated units laminated successively. The insulation layer interval is reserved in the second middleware.

Step S3 refers to the molding procedure, in which the second middleware is molded according to a preset structure, and meanwhile the insulation layer interval is reserved in the second middleware. In the molding process, the base body in the laminated state can be molded according to the application scenario and specific situation of the laminated coil, and the insulating layer interval should be reserved during the molding process.

Step S4 refers to the insulation procedure, in which the insulation layer is wrapped on the base body after the insulation layer is added into the insulation layer interval in the second middleware. In the insulation procedure, the insulation material can be added into the insulation layer interval through spraying, dipping and other processes to form the insulation layer with a certain thickness.

The manufacturing method of a laminated coil in embodiment 4 can improve the manufacturing efficiency of the laminated coils comparing with embodiment 3, by folding the base plate firstly, and then manufacturing the base body with laminated units and implementing the folding, lamination and other processes.

In the laminated coil and the manufacturing method of the laminated coil according to the present application, the base body is sequentially folded to form multiple laminated units, so that the base body in the laminated state forms the spiral power-on path. Based on the laminated coil structure, by using the manufacturing method of the present application, the laminated coil with the rectangular cross-section or rectangular cross-sections can be manufactured with high precision and efficiency. The coil can be processed to have an expected shape for improving the efficiency of the rectangular coil. In addition, the folding process of the present application can significantly reduce the stress generated during the coil manufacture, thus avoiding the crack caused by the tensile and compression stress during the coil manufacture and improving the effectiveness and reliability of the laminated coil. At the same time, with the base body of the present application as the carrier, the superconducting material is attached to the folded and molded base body, the ultra-thin laminated coil can be made, which expanding the application scope of the laminated coil without limiting the material of the base body. The laminated coil and the manufacturing method of the laminated coil according to the present application can effectively improve the manufacture accuracy and efficiency of the laminated coil, and the related products have a wide range of application fields and are of great significance in practical application and economic benefits.

The foregoing is a further detailed description of the present application in connection with specific preferred embodiments, and cannot be considered as that the specific implementation of the present application is limited to these illustrations. It will be apparent to those skilled in the art that any various modifications or substitutions may be made to the present application without departing from the spirit of the invention, and such modifications or substitutions should be considered as falling within the scope of the present application.

The invention claimed is:

1. A laminated coil comprising a plurality of laminated units formed by folding a base body, wherein each laminated unit of the plurality of laminated units comprises an opening, a first common edge and a second common edge, wherein opening directions of two adjacent laminated units are opposite, and the laminated unit is separately jointed with two adjacent laminated units by means of the first common edge and the second common edge, so that the base body in a laminated state forms a spiral power-on path.

2. The laminated coil according to claim 1, wherein the laminated unit comprises a U-shaped unit comprising a first arc edge, a second arc edge, a third arc edge, a fourth arc edge, a first connection edge, a second connection edge, a third connection edge and a fourth connection edge; wherein the first common edge, the first arc edge, the first connection edge, the second arc edge, the second common edge, the third arc edge, the second connection edge, the third connection edge, the fourth connection edge and the fourth arc edge are successively jointed end to end to form the U-shaped unit.

3. The laminated coil according to claim 2, wherein the first arc edge of the U-shaped unit is combined with the fourth arc edge of an adjacent U-shaped unit to form an arc with a center angle of 90°, the second arc edge of the U-shaped unit is combined with the third arc edge of the other adjacent U-shaped unit to form an arc with a center angle of 90°; wherein intervals between the first common edge and the fourth connection edge, between the second common edge and the second connection edge are both equal to a half radius of the arc, an interval between the first connection edge and the third connection edge is equal to a radius of the arc.

4. The laminated coil according to claim 3, wherein the U-shaped unit further comprises a fifth arc edge jointed the second connection edge and the third connection edge, and a sixth arc edge jointed the third connection edge and the fourth connection edge.

5. The laminated coil according to claim 4, wherein the base body is attached with a conductive layer, wherein the conductive layer is on a surface of the base body and an insulation layer is wrapped on the conductive layer.

6. The laminated coil according to claim 3, wherein the base body is attached with a conductive layer, wherein the conductive layer is on a surface of the base body and an insulation layer is wrapped on the conductive layer.

7. The laminated coil according to claim 2, wherein the base body is attached with a conductive layer, wherein the conductive layer is on a surface of the base body and an insulation layer is wrapped on the conductive layer.

8. The laminated coil according to claim 1, wherein the base body is attached with a conductive layer, wherein the conductive layer is on a surface of the base body and an insulation layer is wrapped on the conductive layer.

9. A manufacturing method of a laminated coil comprising following steps:

S1. laminated unit procedure, which comprising processing on a base plate to form a base body including a plurality of laminated units, and reserving a connection unit at both ends of the base body; wherein each laminated unit of the plurality of laminated units comprises an opening, a first common edge and a second common edge, wherein opening directions of two adjacent laminated units are opposite, and the laminated unit is separately jointed with two adjacent laminated units by means of the first common edge and the second common edge;

S2. folding and lamination procedure, which comprising folding the base body along the first common edge and the second common edge of the laminated unit to form a middleware with laminated units laminated successively;

S3. molding procedure, which comprising molding the middleware according to a preset structure, and reserving an insulation layer interval in the middleware; and S4. insulation procedure, which comprising adding an insulation layer into the insulation layer interval in the middleware, and wrapping the insulation layer on the base body.

10. The manufacturing method of a laminated coil according to claim 9, wherein the laminated unit comprises a U-shaped unit comprising a first arc edge, a second arc edge, a third arc edge, a fourth arc edge, a first connection edge, a second connection edge, a third connection edge and a fourth connection edge; wherein the first common edge, the first arc edge, the first connection edge, the second arc edge, the second common edge, the third arc edge, the second connection edge, the third connection edge, the fourth connection edge and the fourth arc edge are successively jointed end to end to form the U-shaped unit.

11. The manufacturing method of a laminated coil according to claim 10, wherein the first arc edge of the U-shaped unit is combined with the fourth arc edge of an adjacent U-shaped unit to form an arc with a center angle of 90°, the second arc edge of the U-shaped unit is combined with the third arc edge of the other adjacent U-shaped unit to form an arc with a center angle of 90°; wherein intervals between the first common edge and the fourth connection edge, between the second common edge and the second connection edge are both equal to a half radius of the arc, an interval between the first connection edge and the third connection edge equal to a radius of the arc.

12. The manufacturing method of a laminated coil according to claim 11, wherein the base body is attached with a conductive layer, wherein the conductive layer is on a surface of the base body and the insulation layer is wrapped on the conductive layer.

13. A manufacturing method of a laminated coil comprising following steps:

S1. folding procedure, which comprising folding a base plate and reserving a connection unit at both ends of the base plate to form a first middleware in a laminated state;

S2. laminated unit procedure, which comprising processing on the first middleware in a laminated state to form a base body with a plurality of hollow laminated units having an opening, wherein opening directions of two adjacent laminated units are opposite, and each laminated unit of the plurality of hollow laminated units is separately jointed with two adjacent laminated units by means of the first common edge and the second common edge to form a second middleware with laminated units laminated successively;

S3. molding procedure, which comprising molding the second middleware according to a preset structure, and reserving an insulation layer interval in the second middleware; and S4. insulation procedure, which comprising adding an insulation layer into the insulation layer interval in the second middleware, and wrapping the insulation layer on the base body.

14. The manufacturing method of a laminated coil according to claim 13, wherein the laminated unit comprises a U-shaped unit comprising a first arc edge, a second arc edge, a third arc edge, a fourth arc edge, a first connection edge, a second connection edge, a third connection edge and a fourth connection edge; wherein the first common edge, the first arc edge, the first connection edge, the second arc edge, the second common edge, the third arc edge, the second connection edge, the third connection edge, the fourth connection edge and the fourth arc edge are successively jointed end to end to form the U-shaped unit.

15. The manufacturing method of a laminated coil according to claim 14, wherein the first arc edge of the U-shaped unit is combined with the fourth arc edge of an adjacent U-shaped unit to form an arc with a center angle of 90°, the second arc edge of the U-shaped unit is combined with the third arc edge of the other adjacent U-shaped unit to form an arc with a center angle of 90°; wherein intervals between the first common edge and the fourth connection edge, between the second common edge and the second connection edge are both equal to a half radius of the arc, an interval between the first connection edge and the third connection edge equal to a radius of the arc.

16. The manufacturing method of a laminated coil according to claim 15, wherein the base body is attached with a conductive layer, wherein the conductive layer is on a surface of the base body and the insulation layer is wrapped on the conductive layer.

* * * * *